US011509085B2

(12) United States Patent
Hsieh

(10) Patent No.: US 11,509,085 B2
(45) Date of Patent: Nov. 22, 2022

(54) CONNECTING SOCKET HAVING ELECTRONIC MEMBER WITH CANTILEVER STRUCTURES

(71) Applicant: Delta Electronics, Inc., Taoyuan (TW)

(72) Inventor: Hung-Sheng Hsieh, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 17/207,146

(22) Filed: Mar. 19, 2021

(65) Prior Publication Data

US 2022/0094096 A1 Mar. 24, 2022

(30) Foreign Application Priority Data

Sep. 23, 2020 (CN) ..... 202011010537.8

(51) Int. Cl.
*H01R 13/11* (2006.01)
*H01R 13/03* (2006.01)
*H01R 13/42* (2006.01)

(52) U.S. Cl.
CPC ..... *H01R 13/111* (2013.01); *H01R 13/03* (2013.01); *H01R 13/42* (2013.01)

(58) Field of Classification Search
CPC ..... H01R 13/111; H01R 13/42; H01R 13/113; H01R 13/114; H01R 13/03
See application file for complete search history.

(56) References Cited

U.S. PATENT DOCUMENTS 6,062,919 A * 5/2000 Trafton ..... H01R 13/187 439/843
8,632,356 B2 * 1/2014 Bihrer ..... H01R 13/111 439/442

(Continued)

FOREIGN PATENT DOCUMENTS

CN 105977676 B 1/2019
DE 112014003160 T5 3/2016

(Continued)

OTHER PUBLICATIONS

Office Action and Search Report of its corresponding TW application No. 109132816 dated Oct. 12, 2021.

(Continued)

*Primary Examiner* — Marcus E Harcum
(74) *Attorney, Agent, or Firm* — Muncy, Geissler, Olds & Lowe, P.C.

(57) ABSTRACT

A connecting socket configured to connect a connector is provided. The connecting socket includes a conductive member, an opening, and an electronic member. The conductive member has a recess. The opening is formed on an end of the connecting socket and communicates with the recess. The electronic member is accommodated in the recess, and has a main body and a plurality of cantilever structures. Each of the cantilever structures includes a fixed end, a free end, a first contact point, and a second contact point. The fixed end is connected to the main body. The free end is disposed between the opening and the fixed end. The first contact point and the second contact point are disposed on opposite surfaces of the cantilever structure. When the connecting socket is connected to the connector, the first and second contact points respectively contact the connector and the conductive member.

18 Claims, 5 Drawing Sheets

(56) References Cited

U.S. PATENT DOCUMENTS

| | | | | |
|---|---|---|---|---|
| 10,923,846 | B1 * | 2/2021 | Raybold | H01R 13/187 |
| 11,139,600 | B1 * | 10/2021 | Kinsey, Jr. | H01R 13/111 |
| 2012/0003882 | A1 * | 1/2012 | Stewart | H01R 13/187 439/840 |
| 2012/0282797 | A1 * | 11/2012 | Mott | H01R 13/187 439/357 |
| 2016/0134044 | A1 | 5/2016 | Hirakawa et al. | |
| 2018/0337479 | A1 | 11/2018 | Machida et al. | |
| 2020/0313355 | A1 * | 10/2020 | Bronk | H01R 13/502 |
| 2020/0403343 | A1 * | 12/2020 | Bronk | H01R 13/6315 |
| 2021/0104834 | A1 * | 4/2021 | Hashiguchi | H01R 13/187 |
| 2021/0281000 | A1 * | 9/2021 | Huang | H01R 13/11 |

FOREIGN PATENT DOCUMENTS

| | | | | |
|---|---|---|---|---|
| EP | 0856913 | A1 * | 8/1998 | |
| TW | M598550 | U | 7/2020 | |
| WO | WO-2020249497 | A1 * | 12/2020 | H01R 13/187 |

OTHER PUBLICATIONS

Extended Search Report of its corresponding EP application No. 21186742.9 dated Jan. 4, 2022.

* cited by examiner

CONNECTING SOCKET HAVING ELECTRONIC MEMBER WITH CANTILEVER STRUCTURES

CROSS REFERENCE TO RELATED APPLICATIONS

This application claims the benefit of China Patent Application No. 202011010537.8, filed Sep. 23, 2020, the entirety of which is incorporated by reference herein.

BACKGROUND OF THE INVENTION

Field of the Invention

The application relates in general to a connecting socket, and in particular, to a connecting socket having an electronic member.

Description of the Related Art

Many electronic devices use connecting structures to electrically connect other electronic devices, so as to transmit power, signals, or data. However, if the connecting structure is not properly designed and a large current flows through the connector during the transmission, the temperature of the terminal where the plug is in contact with the socket of the connecting structure may become higher, the transmission efficiency may be reduced, and the connector may be further damaged due to the high temperature. Therefore, how to address the aforementioned problem has become an important issue.

BRIEF SUMMARY OF INVENTION

To address the deficiencies of conventional products, an embodiment of the invention provides a connecting socket configured to connect a connector. The connecting socket includes a conductive member, an opening, and an electronic member. The conductive member has a recess. The opening is formed on an end of the connecting socket and communicates with the recess. The electronic member is accommodated in the recess, and has a main body and a plurality of cantilever structures. Each of the cantilever structures includes a fixed end, a free end, a first contact point, and a second contact point. The fixed end is connected to the main body of the electronic member, and the free end is disposed between the opening and the fixed end. The first contact point and the second contact point are disposed on opposite surfaces of the cantilever structure. When the connecting socket is connected to the connector, the first contact point contacts the connector, and the second contact point contacts the conductive member.

In some embodiments, the main body has an inner surface, and the first contact point protrudes from the inner surface.

In some embodiments, the recess has a bottom surface and a lateral wall, the lateral wall is disposed between the opening and the bottom surface, and some of the cantilever structures are arranged in a line from the bottom surface to the opening. The connecting socket includes a main axis passing through the center of the bottom surface and the center of the opening. The line is parallel to the main axis. In some embodiment, the line is inclined relative to the main axis.

In some embodiments, some cantilever structures surround the main axis.

In some embodiments, the electrical conductivity of the conductive member is greater than the electrical conductivity of the electronic member, and the electronic member has high elasticity. The cantilever structures are electrically connected to each other in parallel via the main body. A plate structure is formed between the second contact point and the fixed end.

In some embodiments, the distance between the first contact point and the second contact point is less than the distance between the second contact point and the fixed end. In some embodiments, the distance between the first contact point and the second contact point is greater than the distance between the second contact point and the fixed end.

In some embodiments, the connecting socket further comprises a positioning member, and the positioning member is engaged with the conductive member and configured to affix the electronic member in the recess. The opposite ends of the electronic member are respectively in contact with the positioning member and the bottom surface. The opening is formed on the positioning member. The positioning member comprises low electrical conductivity material or non-electrical conductivity material.

In some embodiments, the cantilever structures are parallel to each other. The main body has an outer surface, and the electronic member further comprises a plurality of protrusions. The protrusions protrude from the outer surface and are in contact with the conductive member. Some protrusions are adjacent to the bottom surface of the recess.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The making and using of the embodiments of the connecting socket are discussed in detail below. It should be appreciated, however, that the embodiments provide many applicable inventive concepts that can be embodied in a wide variety of specific contexts. The specific embodiments discussed are merely illustrative of specific ways to make and use the embodiments, and do not limit the scope of the disclosure.

Unless defined otherwise, all technical and scientific terms used herein have the same meaning as commonly understood by one of ordinary skill in the art to which this invention belongs. It should be appreciated that each term, which is defined in a commonly used dictionary, should be interpreted as having a meaning conforming to the relative skills and the background or the context of the present disclosure, and should not be interpreted in an idealized or overly formal manner unless defined otherwise.

Figure 1:
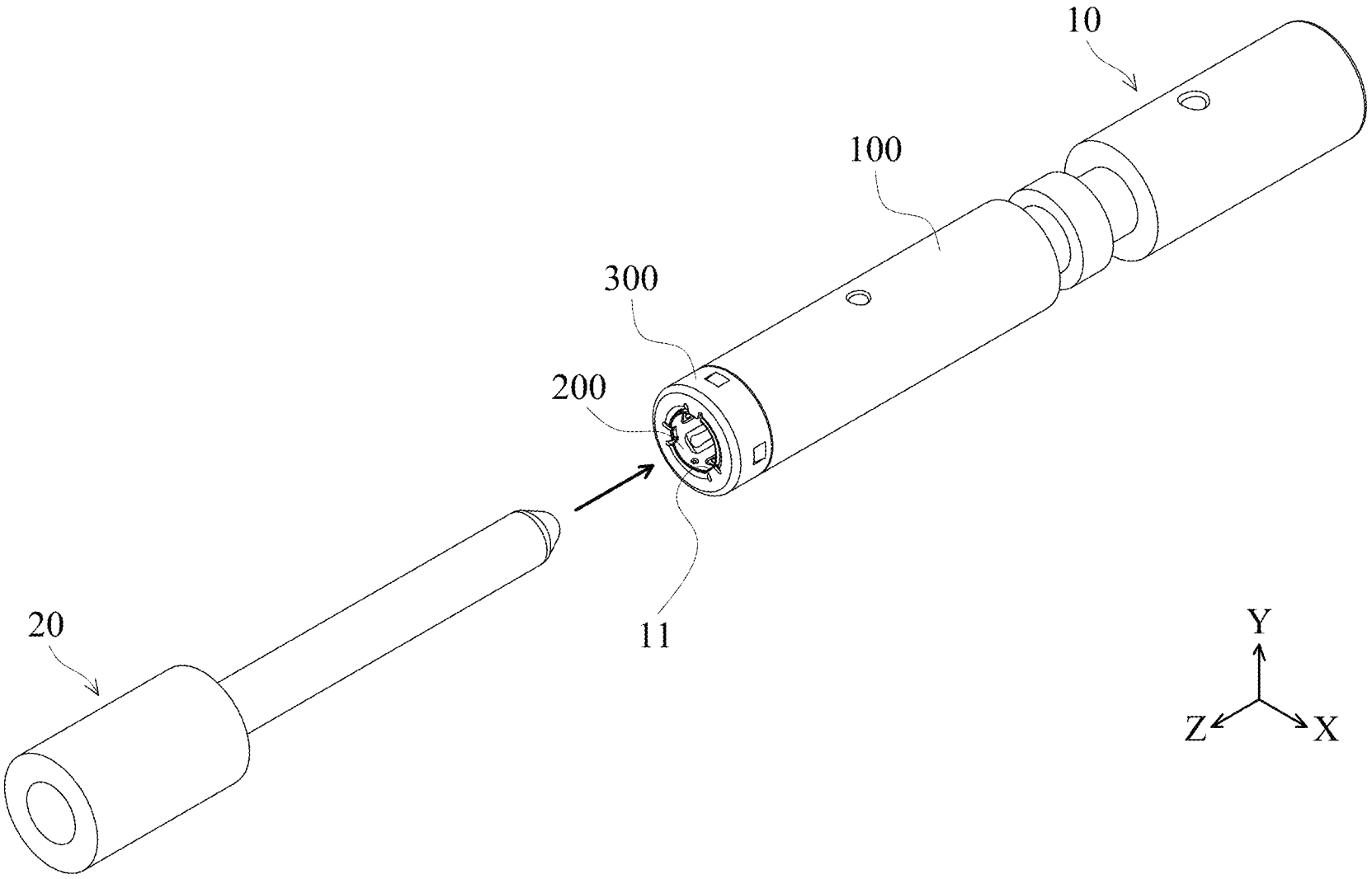
FIG. 1 is a schematic diagram of a connector and a connecting socket connected to each other according to an embodiment of the invention.

Referring to FIG. 1, in an embodiment of the invention, a connecting socket 10 can be a female receiver, and can be configured to connect to a male connector 20. Power, signal, and/or data can be transmitted between the connecting socket 10 and the connector 20 by connecting the connector 20 to the connecting socket 10. For example, in this embodiment, the connector 20 can be one of a plurality of terminals on an alternating current (AC) charging plug or an direct current (DC) charging plug, and the connecting socket 10 can be one of a plurality of terminals on a charging port.

In some embodiments, the connector 20 can be a terminal of an AC power plug, and the connecting socket 10 can be a terminal of an AC power socket. In some embodiments, the connector 20 and the connecting socket 10 can respectively be a terminal of a plug and a terminal of a socket of an AC/DC electric vehicle connector, an AC/DC machine tool connector, or a connecting apparatus which requires transmitting a large current, but it is not limited thereto.

Figure 2:
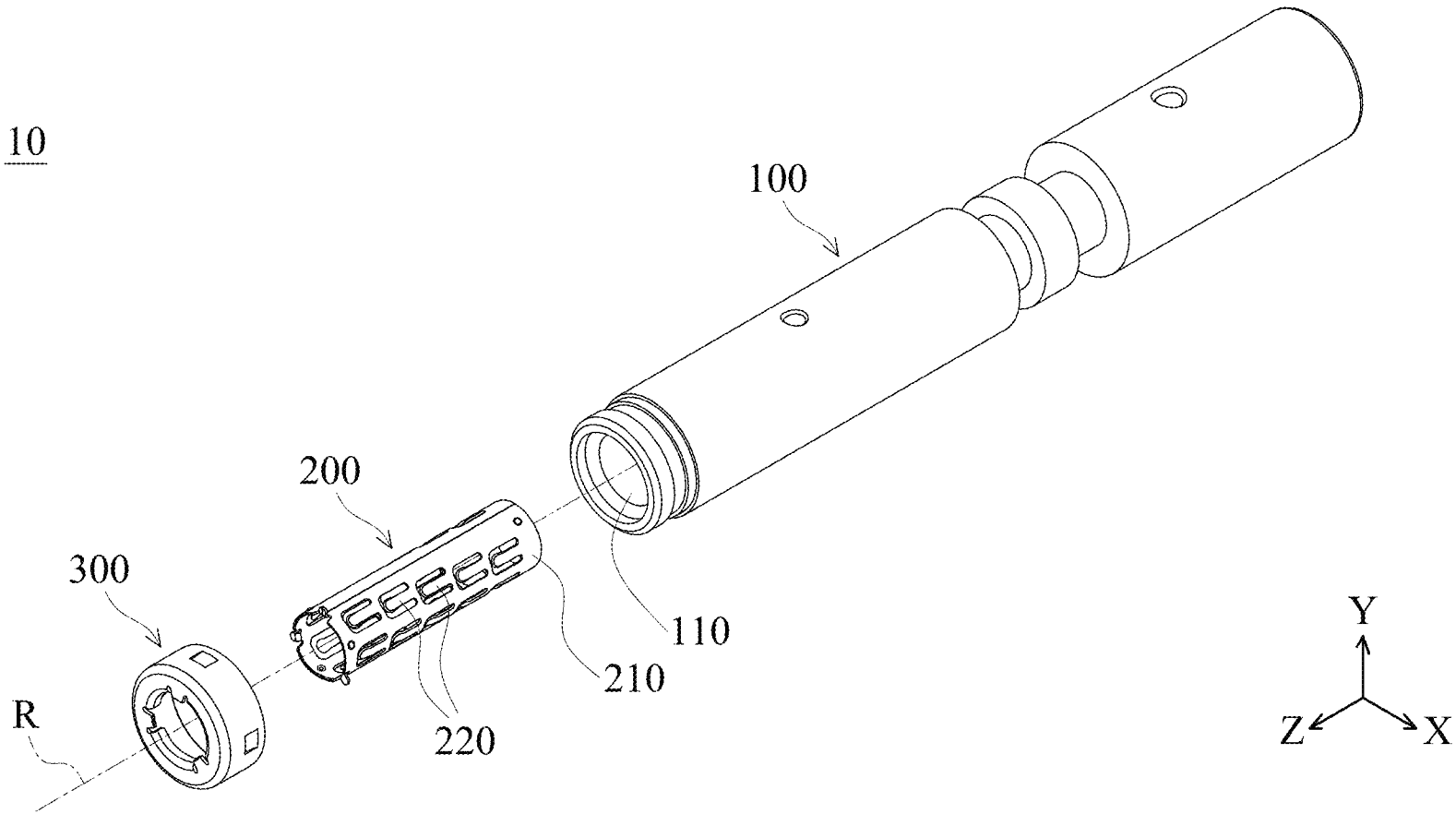
FIG. 2 is an exploded-view diagram of the connecting socket according to an embodiment of the invention.
Figure 3:
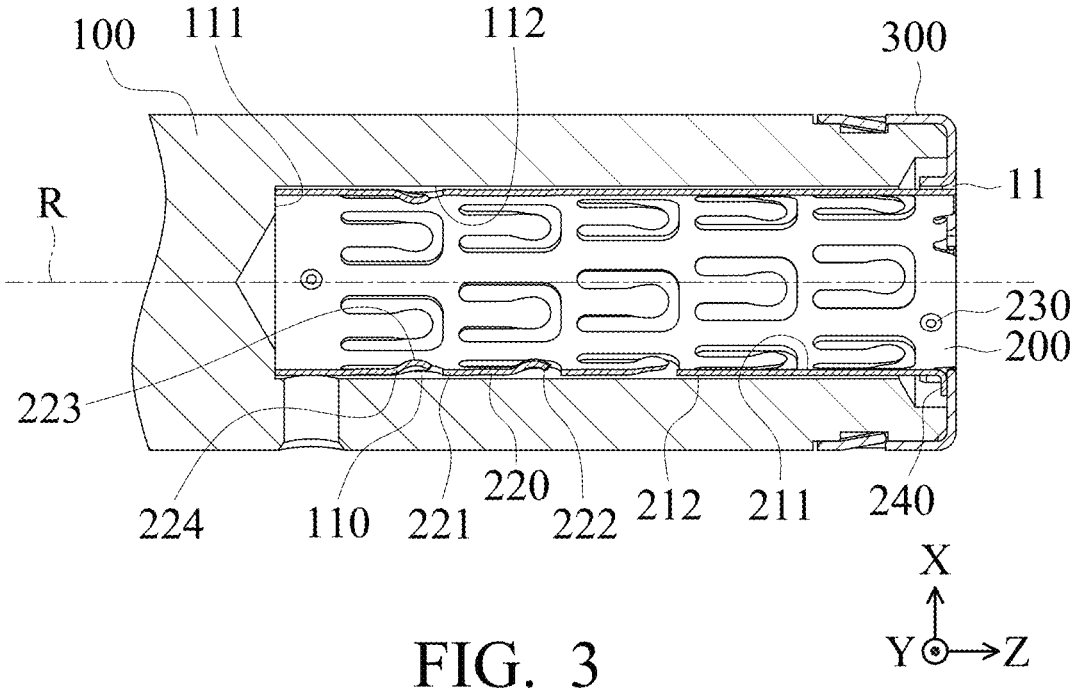
FIG. 3 is a partial cross-sectional view of the connecting socket according to an embodiment of the invention.
Figure 4:
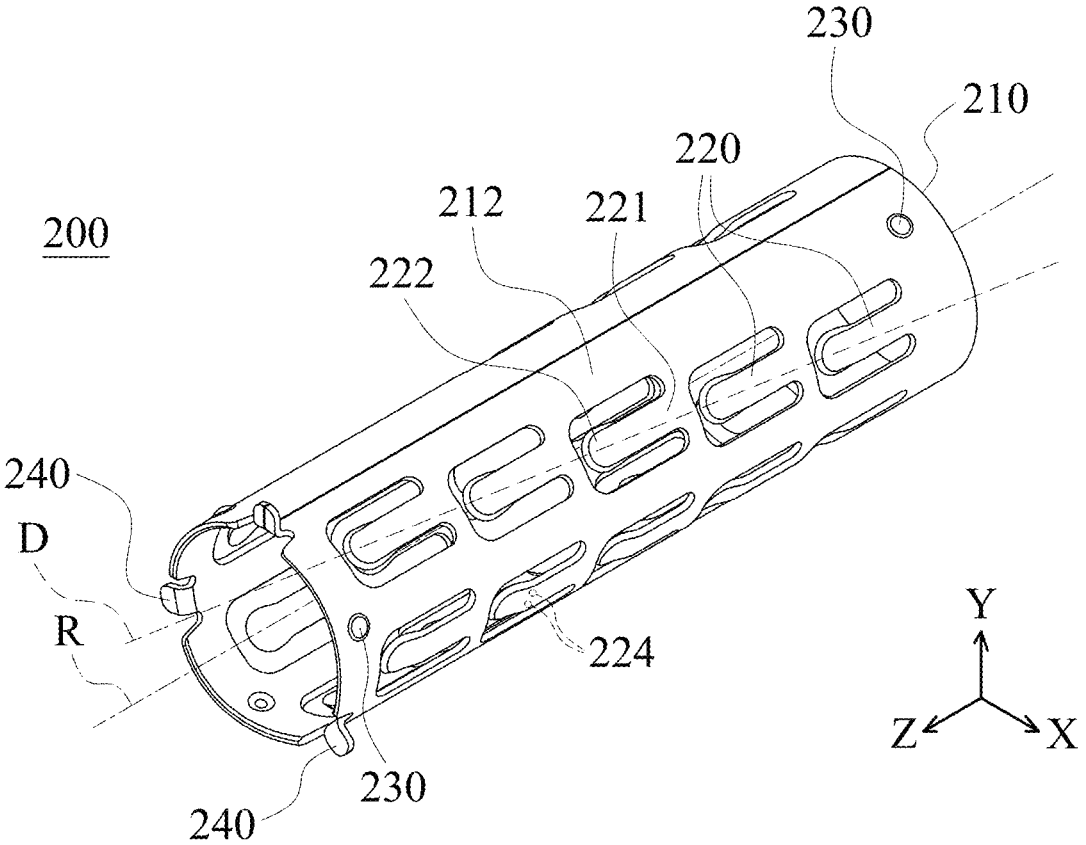
FIG. 4 is a schematic diagram of an electronic member according to an embodiment of the invention.

As shown in FIGS. 1-3, the connecting socket 10 includes an opening 11, and the connector 20 can passes through the opening 11 to connect to the connecting socket 10. The connecting socket 10 primarily includes a conductive member 100, an electronic member 200, and a positioning member 300. The conductive member 100 includes conductive material, and has a recess 110 communicating with the opening 11. For example, the conductive member 100 can be made by pure copper or brass.

The recess 110 includes a bottom surface 111 and a lateral wall 112, wherein the bottom surface 111 faces the opening 11, and the lateral wall 112 is extended from the bottom surface 111 to the opening 11. In this embodiment, the depth of the recess 110 (i.e. the distance from the bottom surface 111 to the opening 11) is substantially the same as the length of the electronic member 200, and the dimensions of the portion of the recess 110 adjacent to the opening 11 is larger than the dimensions of the portion of the recess 110 adjacent to the bottom surface 111. Furthermore, a line extending from the center of the bottom surface 111 to the center of the opening 11 can be defined as a main axis R of the recess 110.

Referring to FIGS. 1-4, the electronic member 200 is disposed in the recess 110 of the conductive member 100, and includes a main body 210 and a plurality of cantilever structures 220. The main body 210 substantially includes a hollow cylindrical structure, and the cantilever structures 220 are disposed on the main body 210, wherein the cantilever structures 220 are separated from each other and parallel to each other. Each of the cantilever structures 220 includes a fixed end 221 and a free end 222. The fixed end 221 is connected to the main body 210, and the free end 222 can rotate relative to the main body 210 with the fixed end 221 as the center. Specifically, the free end 222 is disposed between the fixed end 221 and the opening 11 of the connecting socket 10.

Each of the cantilever structures 220 includes at least one first contact point 223 and at least one second contact point 224, respectively situated on opposite surfaces of the cantilever structure 220. The first contact point 223 protrudes from an inner surface 211 of the main body 210, and is adjacent to the free end 222 of the cantilever structure 220. The second contact point 224 and an outer surface 212 of the main body 210 face the inner wall of the recess 110, and the second contact point 224 is disposed between the first contact point 223 and the fixed end 221 of the cantilever structure 220. Therefore, the distance between the second contact point 224 and the fixed end 221 is less than the distance between the first contact point 223 and the fixed end 221. In this embodiment, the distance between the first contact point 223 and the second contact point 224 is less than the distance between the second contact point 224 and the fixed end 221.

The cantilever structures 220 on the electronic member 200 are arranged from the bottom surface 111 of the recess 110 to the opening 11, and arranged around the main axis R of the recess 110. In this embodiment, the arrangement direction D of the cantilever structures 220 is inclined relative to the main axis R. That is, the direction of the cantilever structures 220 arranged from the bottom surface 111 of the recess 110 to the opening 11 is dislocated.

The electronic member 200 further includes a plurality of protrusions 230. The protrusions 230 are disposed on the main body 210 and protrude from an outer surface 212 of the main body 210. The positions of the protrusions 230 are adjacent to opposite ends of the electronic member 200. In other words, some protrusions 230 are adjacent to the bottom surface 111 of the recess 110, and some protrusions 230 are adjacent to the opening 11 of the conductive member 100. When the electronic member 200 is disposed in the recess 110 of the conductive member 100, the protrusions 230 adjacent to the bottom surface 111 of the recess 110 are in contact with the inner wall of the recess 110. Therefore, the outer surface 212 of the main body 210 is spaced away from the inner wall of the recess 110. The outer surface 212 of the main body 210 is not directly in contact with the inner wall of the recess 110.

Figure 5:
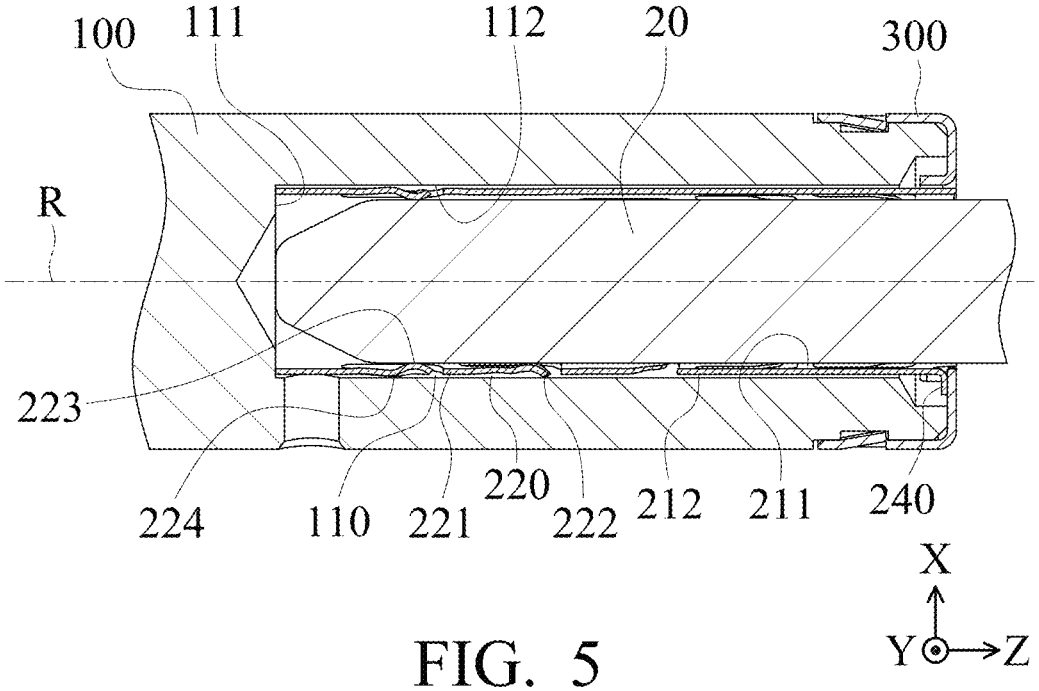
FIG. 5 is a partial cross-sectional view of the connector inserting into a recess of the connecting socket according to an embodiment of the invention.

As shown in FIG. 5, when the connector 20 enters the recess 110 and connects the connecting socket 10, the connector 20 is in contact with the first contact points 223 of the cantilever structures 220 and pushes the cantilever structures 220 to be curved. The second contact points 224 of the cantilever structures 220 are therefore in contact with the inner wall of the recess 110. Since the electronic member 200 includes conductive material, the connector 20 can transmit power, signal, and/or data to the conductive member 100 via the cantilever structures 220 of the electronic member 200.

It should be noted that, when the connector 20 enters the recess 110 and connects the connecting socket 10, the connector 20 is not in contact with the inner wall 211 of the main body 210. Moreover, since the distance between the first contact point 223 and the second contact point 224 is short, the current from the connector 20 can be rapidly transmitted to the conductive member 100, and the energy does not stay on the cantilever structures 220. Therefore, the condition in that the temperature becomes higher at partial portion (joule heating) can be avoided. Furthermore, the cantilever structures 220 are arranged on the main body 210 of the electronic member 200 in a checkerboard-shaped manner, and the arrangement direction D of the cantilever structures 220 arranged along the depth direction of the recess 110 is inclined relative to the main axis R, so that the current flowing through the conductive member 100 can be dispersed. The condition in that the temperature becomes higher at partial portion can be further prevented. For example, when the room temperature is 25° C. and the current with 80 ampere flows from the connector 20 to the connecting socket 10, the highest temperature of the portion of the connecting socket 10 is only 60° C.-80° C. (such as 70° C.). In addition, compared to the embodiment in FIG.

7A (the arrange direction D of the cantilever structures 220 is parallel to the main axis R), because the arrange direction D of the cantilever structures 220 is inclined relative to the main axis R, the number of friction of the cantilever structures at the same curved surface of the inner wall can be reduced, and the service lift of the product can be increase due to the reduced wear.

The electronic member 200 includes conductive metal material with high elasticity, such as beryllium copper, phosphor bronze, or brass, but it is not limited thereto. In this embodiment, the electrical conductivity of the conductive member 100 is greater than that of the electronic member 200.

In this embodiment, the electronic member 200 is formed by the following steps. The cantilever structures 220 can be formed on a metal plate by drilling and/or other suitable method, and then the metal plate can be bent to form the hollow cylindrical structure. Thus, the portion of each of the cantilever structures 220 from the fixed end 221 to the second contact point 224 has a plate structure. Since the inner wall of the recess 110 has an arc shape, each of the cantilever structures 220 has two second contact point 224 in this embodiment.

Referring to FIGS. 1-4, the positioning member 300 can be engaged with the conductive member 100, so as to position the electronic member 200 in the recess 110 of the conductive member 100. In this embodiment, the opening 11 of the connecting socket 10 is formed on the positioning member 300, and the positioning member 300 is made by low electrical conductivity material or non-electrical conductivity material (such as stainless steel or plastic).

Figure 6:
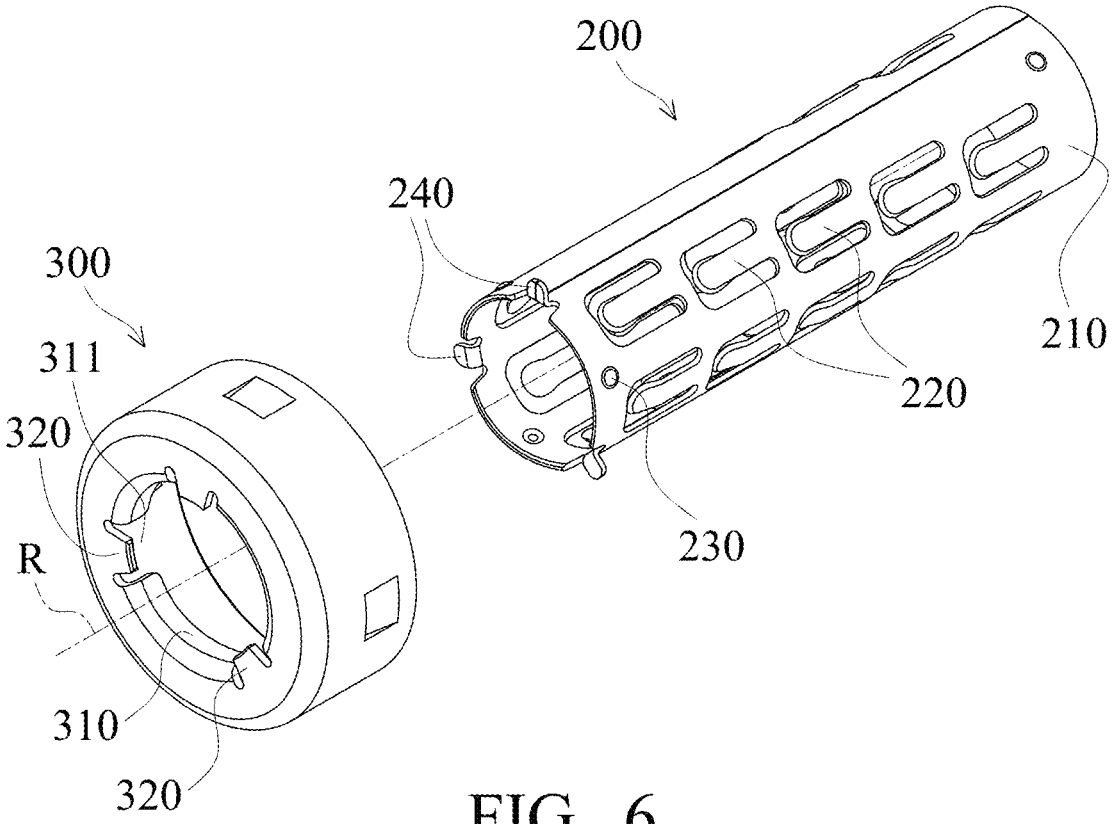
FIG. 6 is schematic diagram of the electronic member and a positioning member according to an embodiment of the invention.

As shown in FIG. 6, at least one extending portion 240 is formed on the end of the electronic member 200 adjacent to the opening 11. The extending portion 240 is connected to the main body 210 and protrudes from the outer surface 212 of the main body 210. When the electronic member 200 is disposed in the recess 110 of the conductive member 100, the end of the electronic member 200 adjacent to the bottom surface 111 of the recess 110 is in contact with the bottom surface 111, and the other end of the electronic member 200 is in contact with the positioning member 300 via the extending portion 240. Therefore, the position of the electronic member 200 in the main axis R can be fixed.

The protrusion 230 of the electronic member 200 adjacent to the opening 11 can also be in contact with the positioning member 300, so that the position of the electronic member 200 in the X-axis and/or Y-axis can be fixed more steadily. Since the positioning member 300 is made by low electrical conductivity material or non-electrical conductivity material, when the connector 200 inserts, the current does not flow into the conductive member 100 from the protrusion 230 adjacent to the opening 11. The efficacy of the cantilever structures 220 in that reducing the temperature becoming higher at partial portion can be maintained.

In this embodiment, at least one bending portion 310 is formed on the positioning member 300 at the opening 11, and the bending portion 310 is extended toward the recess 110 of the conductive member 100. The protrusion 230 of the electronic member 200 is in contact with the wall of the bending portion 310. Moreover, at least one notch 311 is formed on the bending portion 310. When the electronic member 200 is disposed in the recess 110 of the conductive member 100, the extending portion 240 of the electronic member 200 passes through the notch 311 and is in contact with the plate portion 320 of the positioning member 300 corresponding to the notch 311. Thus, the electronic member 200 can be positioned.

Figure 7A:
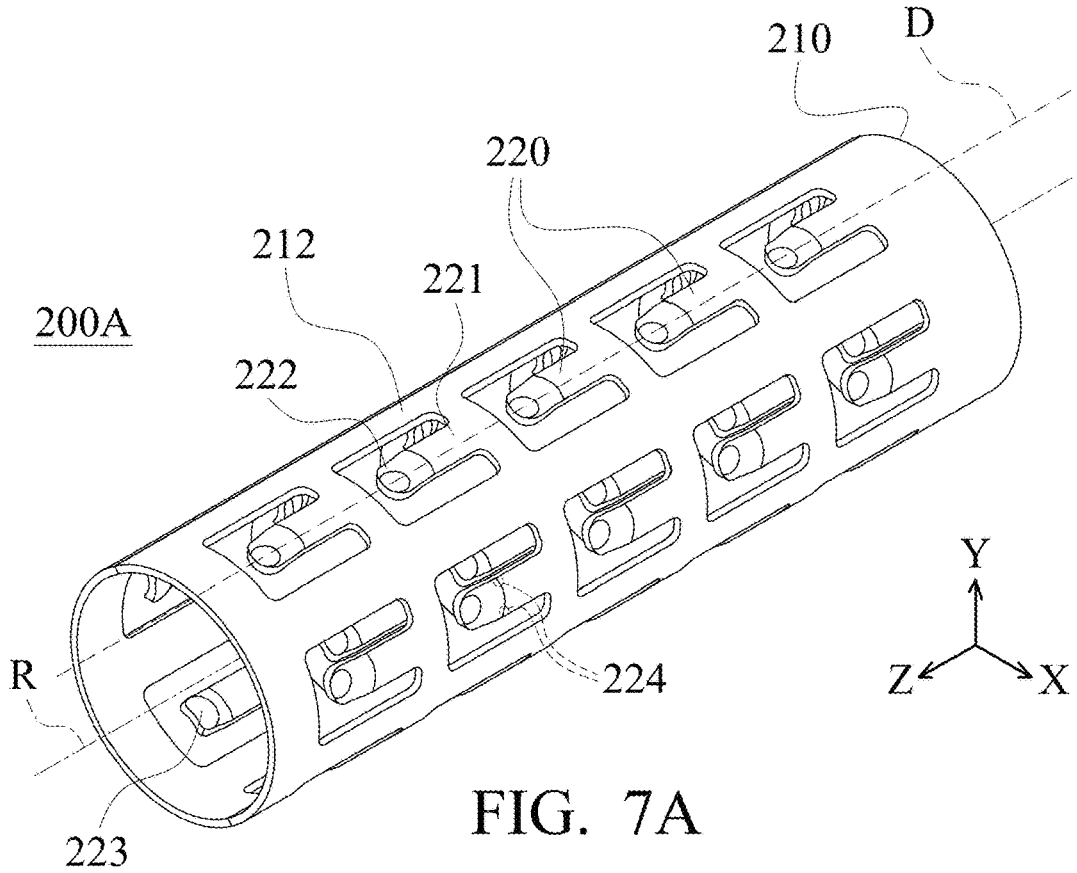
FIG. 7A is a schematic diagram of an electronic member according to another embodiment of the invention.

The connecting socket 10 can include electronic member with other types. For example, the electronic member 200 of the connecting socket 10 can be replaced by the electronic member 200A shown in FIG. 7A. The electronic member 200A is similar to the electronic member 200, so that the same features thereof are not repeated in the interest of brevity. The difference of the electronic member 200A is in that the arrangement direction D of the cantilever structures 220 of the electronic member 200A is parallel to the main axis R. Thus, the manufacture of the electronic member 200A can be facilitated, and the reliability of the structure of the electronic member 200A can be enhanced.

Figure 7B:
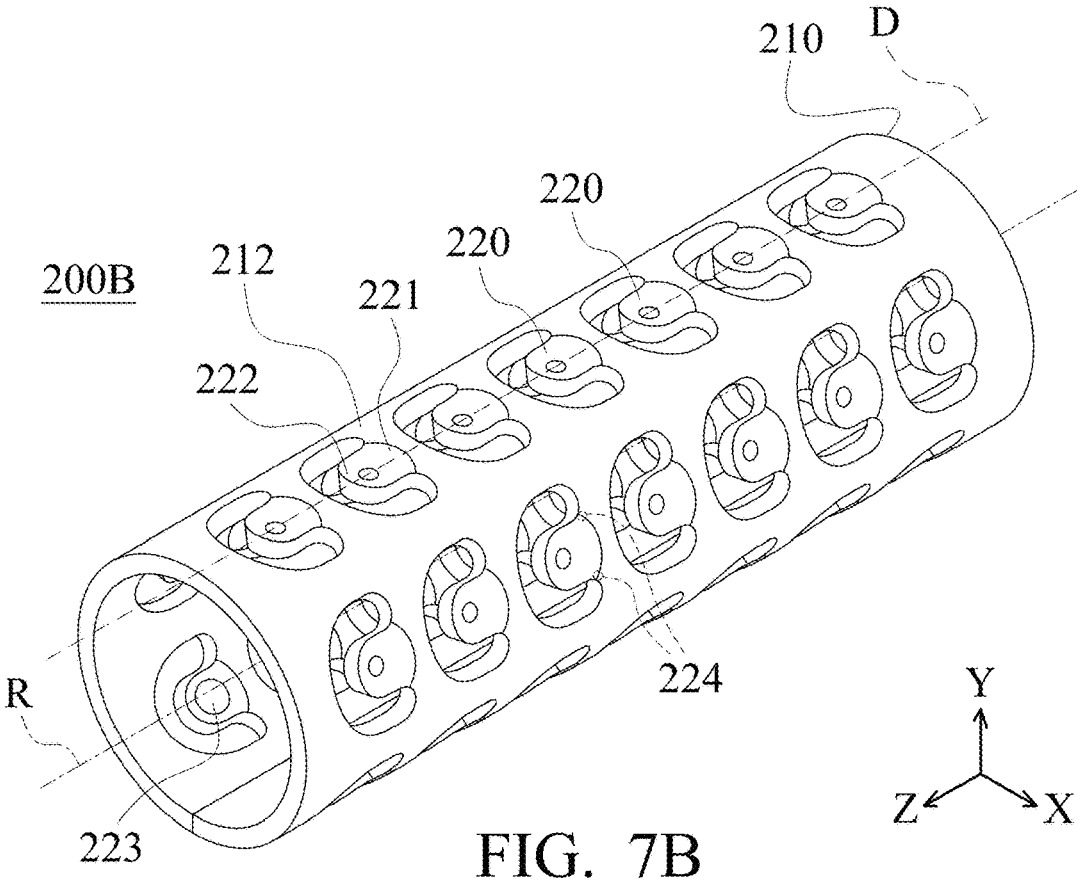
FIG. 7B is a schematic diagram of an electronic member according to another embodiment of the invention.

Referring to FIG. 7B, the electronic member 200 of the connecting socket 10 can be replaced by the electronic member 200B shown in FIG. 7B. The electronic member 200B is similar to the electronic member 200, so that the same features thereof are not repeated in the interest of brevity. The difference of the electronic member 200B is in that the arrangement direction D of the cantilever structures 220 of the electronic member 200B is parallel to the main axis R, and the distance between the first contact point 223 and the second contact point 224 is larger than the distance between the second contact point 224 and the fixed end 221. Thus, the reliability of the structure of the electronic member 200B can be more enhanced, and the dimensions of the connecting socket 10 can be reduced.

In summary, a connecting socket configured to connect a connector is provided. The connecting socket includes a conductive member, an opening, and an electronic member. The conductive member has a recess. The opening is formed on an end of the connecting socket and communicates with the recess. The electronic member is accommodated in the recess, and has a main body and a plurality of cantilever structures. Each of the cantilever structures includes a fixed end, a free end, a first contact point, and a second contact point. The fixed end is connected to the main body of the electronic member, and the free end is disposed between the opening and the fixed end. The first contact point and the second contact point are disposed on opposite surfaces of the cantilever structure. When the connecting socket is connected to the connector, the first contact point contacts the connector, and the second contact point contacts the conductive member.

Although some embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, compositions of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. Moreover, the scope of the appended claims should be accorded the broadest interpretation so as to encompass all such modifications and similar arrangements.

While the invention has been described by way of example and in terms of preferred embodiment, it should be understood that the invention is not limited thereto. On the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A connecting socket, configured to connect a connector, wherein the connecting socket comprises:

a conductive member, having a recess;

an opening, formed on an end of the connecting socket, and communicating with the recess; and an electronic member, accommodated in the recess, and having a main body and a plurality of cantilever structures, wherein each of the cantilever structures comprises:

a fixed end, connected to the main body of the electronic member;

a free end, disposed between the opening and the fixed end;

a first contact point; and a second contact point, wherein the first contact point and the second contact point are disposed on opposite surfaces of each of the cantilever structures, wherein when the connecting socket is connected to the connector, the first contact point is in contact with the connector, and the second contact point is in contact with the conductive member;

wherein the recess has a bottom surface and a lateral wall, the lateral wall is disposed between the opening and the bottom surface, and some of the cantilever structures are arranged in a line from the bottom surface to the opening, wherein the main body has an outer surface, the electronic member further comprises a plurality of protrusions, the protrusions protrude from the outer surface and are in contact with the conductive member.

2. The connecting socket as claimed in claim 1, wherein the main body has an outer surface, and the outer surface is spaced away from the conductive member.

3. The connecting socket as claimed in claim 1, wherein the main body has an inner surface, and the first contact point protrudes from the inner surface.

4. The connecting socket as claimed in claim 1, wherein the connecting socket includes a main axis passing through the center of the bottom surface and the center of the opening, and the line is parallel to the main axis.

5. The connecting socket as claimed in claim 1, wherein the connecting socket includes a main axis passing through the center of the bottom surface and the center of the opening, and the line is inclined relative to the main axis.

6. The connecting socket as claimed in claim 1, wherein the connecting socket includes a main axis, the recess has a bottom surface, and the main axis passes through the center of the bottom surface and the center of the opening, wherein some cantilever structures surround the main axis.

7. The connecting socket as claimed in claim 1, wherein the electrical conductivity of the conductive member is greater than the electrical conductivity of the electronic member.

8. The connecting socket as claimed in claim 1, wherein the electronic member has high elasticity.

9. The connecting socket as claimed in claim 1, wherein the cantilever structures are electrically connected to each other in parallel via the main body.

10. The connecting socket as claimed in claim 1, wherein a plate structure is formed between the second contact point and the fixed end.

11. The connecting socket as claimed in claim 1, wherein the distance between the first contact point and the second contact point is less than the distance between the second contact point and the fixed end.

12. The connecting socket as claimed in claim 1, wherein the distance between the first contact point and the second contact point is greater than the distance between the second contact point and the fixed end.

13. The connecting socket as claimed in claim 1, wherein the connecting socket further comprises a positioning member, and the positioning member is engaged with the conductive member and configured to affix the electronic member in the recess.

14. The connecting socket as claimed in claim 13, wherein the recess has a bottom surface, and opposite ends of the electronic member are respectively in contact with the positioning member and the bottom surface.

15. The connecting socket as claimed in claim 13, wherein the opening is formed on the positioning member.

16. The connecting socket as claimed in claim 13, wherein the positioning member comprises low electrical conductivity material or non-electrical conductivity material.

17. The connecting socket as claimed in claim 13, wherein the electronic member comprises at least one extending portion, the main body has an outer surface, and the extending portion protrudes from the outer surface, wherein the extending portion is in contact with the positioning member.

18. The connecting socket as claimed in claim 1, wherein the recess has a bottom surface, and some protrusions are adjacent to the bottom surface.

* * * * *